United States Patent [19]

Greenberger

[11] 3,941,611

[45] Mar. 2, 1976

[54] APPARATUS FOR COOLING STRIP LIKE MATERIAL

[75] Inventor: Joseph Irwin Greenberger, Pittsburgh, Pa.

[73] Assignee: Wean United, Inc., Pittsburgh, Pa.

[22] Filed: Nov. 4, 1974

[21] Appl. No.: 520,812

[52] U.S. Cl. ..... 134/64 R; 134/182; 134/198; 239/563; 266/3 R; 266/6 S

[51] Int. Cl.[2] ..... B08B 3/02

[58] Field of Search ..... 134/15, 64 R, 122, 131, 134/154, 182, 191, 198; 239/562, 563; 266/3 R, 6 S

[56] References Cited

UNITED STATES PATENTS

| | | | |
|---|---|---|---|
| 2,718,712 | 9/1955 | Bruker et al. | 239/562 X |
| 3,025,865 | 3/1962 | Adcock | 134/182 X |
| 3,299,900 | 1/1967 | Stone et al. | 134/122 |
| 3,405,627 | 10/1968 | Day et al. | 134/122 X |

*Primary Examiner*—Robert L. Bleutge
*Attorney, Agent, or Firm*—Daniel Patch; Henry C. Westin

[57] ABSTRACT

An apparatus for distributing a controlled flow of water onto passing hot strips in proportion to the varying width of strips as they issue from a hot strip rolling mill.

5 Claims, 3 Drawing Figures

APPARATUS FOR COOLING STRIP LIKE MATERIAL

The present invention pertains to an apparatus for cooling hot rolled strips and the like prior to their coiling. Presently, in producing hot rolled strips of a hot strip mill the strips are subject to controlled water cooling as they pass from the mill and while they are passing over the hot run-out table. The two most common forms for cooling the strips are to employ either a high pressure system in which water under high pressure is delivered to nozzles arranged transversely of the passing strips for delivering water under high pressure to the adjacent surfaces of the strips. The second form is a low pressure system which in some form is sometimes referred to as a "laminar" cooling system. In this system the water is delivered under a low pressure of the order of one to five pounds per square inch in which there is employed a series of nozzles for guiding the water from headers onto the passing strips. Both of these systems have one very serious limitation and drawback in that they are constructed and operated so that the total width of the nozzles or header coverage is made sufficient to accommodate the maximum width strip produced by the mill, and even though less than maximum width strip is rolled, the nozzles or header continues to deliver water for the maximum width strip coverage. When it is considered that the great majority of the production produced by the mill is considerably less than the maximum width product, it can readily be appreciated that not only is there a considerable percentage of water not being used but also a substantial monetary loss is involved by the additional pumping power consumed, the additional cost of maintenance, and the substantial unnecessary loss of water by evaporation.

These factors may be better appreciated from a consideration of the following information pertaining to the specification of a recent hot strip mill: This mill was designed to roll a maximum strip 84 inches wide in which the headers were designed to cover a strip width of 84 inches; the mill, however, has an average strip width of between 40 to 42 inches in which probably 80% of the strip rolled was under 45 inches wide. This means that the 84 inch water header coverage was being utilized under 50% or less coverage efficiency for most of the rolling operation.

It is, therefore, an object of the present invention to provide a strip cooling apparatus for distributing coolant in proportion to the varying width of the strip in which the very maximum economy of the medium can be realized, along with the most economical employment of the pumping system and obtaining of low maintenance costs.

A still further object of the present invention is to provide a header mounted over the passing strip for receiving the coolant medium, a number of discharge members carried by said header arranged relative to the upper flat surface of the passing strip to form a transverse cooling zone approximately equal in width to the maximum width strip for delivering said coolant medium from said header to the strip, means for departmentalizing said discharge members into two or more groups or areas, and means for selectively delivering and interrupting said coolant medium for at least one of said groups of said discharge members in a manner that the effective cooling width of the zone can be varied to optimize the use of the coolant medium for the particular product being rolled.

Another object of the present invention is to provide a number of headers as above described including a common means to operate the means for selectively delivering coolant medium to the one group.

These objects as well as other novel features and advantages of the present invention will be better understood when the following description of one embodiment thereof is read along with the accompanying drawings of which:

Figure 1:
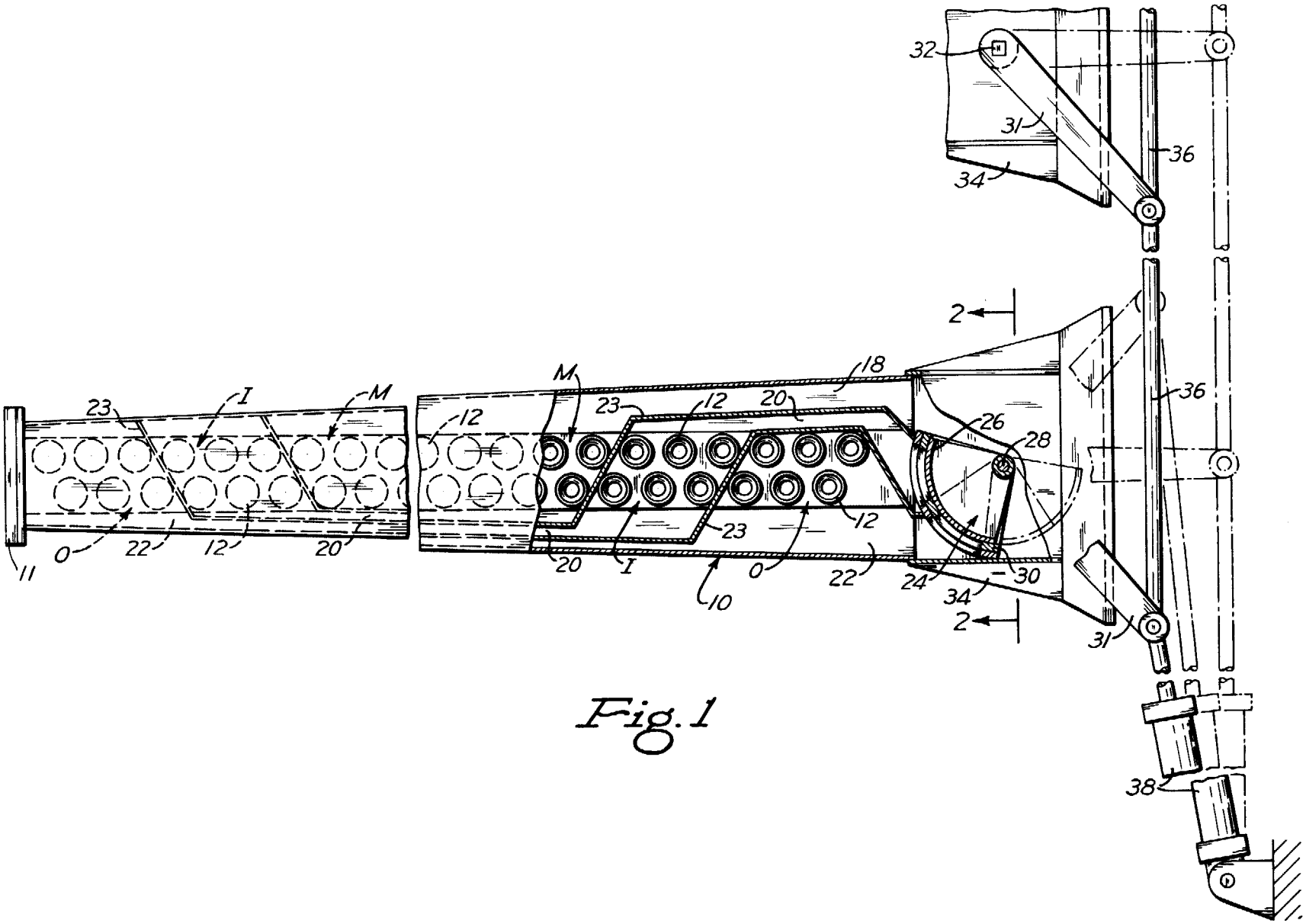
FIG. 1 is a plan view, partly in section, of a cooling apparatus built in accordance with the present invention.

In referring first to FIG. 1, it will be appreciated that the cooling apparatus illustrated is mounted on a support structure so that it overhangs passing hot strips issuing from a hot rolling mill, the strips during this period actually being supported by the customary hot run-out table arranged between the mill and the down coilers, none of these other elements, however, being shown. It will also be appreciated that while only one apparatus is being fully shown, according to the general practice, a plurality of banks of cooling apparatuses are employed, in which each bank will be made up of from six to eight separate cooling apparatuses.

Figure 3:
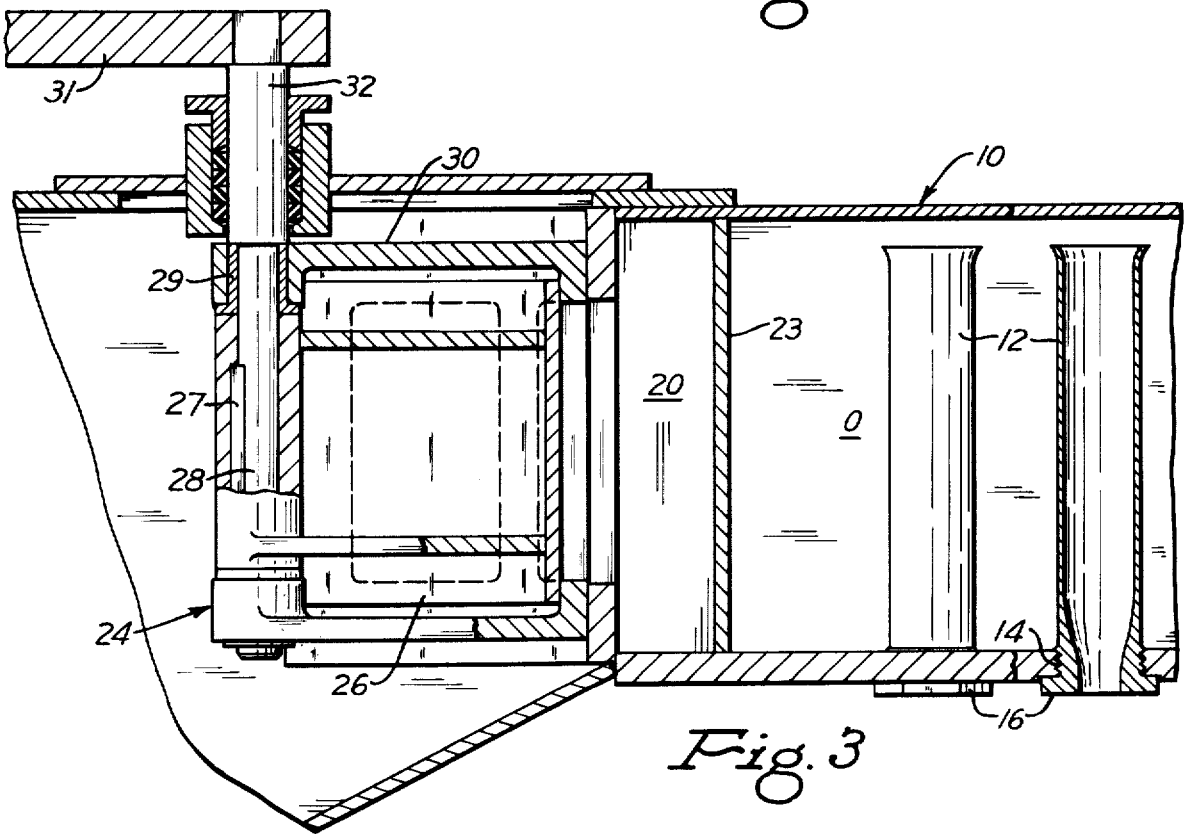
FIG. 3 is a sectional view taken on lines 3-3 of FIG. 2.

The cooling apparatus illustrated comprises a header 10 which takes the form of a rectangular tapered enclosure having its narrowest end on the operating side of the mill, which is closed at this end by an end plate 11. As FIG. 1 illustrates, the header 10 includes a number of vertically arranged equally spaced nozzles 12 arranged in two parallel, staggered rows and adapted to extend a distance equal to the approximate width of the maximum width strip. FIG. 3 best illustrates the mounting of the individual nozzles 12 in which the nozzles are secured to the lower exterior horizontal surface of the header 10 by being provided with threads 14 at the lower end of the nozzles arranged inside a nut-shaped outer portion 16. In still referring to FIG. 3, it will be observed that the top of the nozzles 12 are flared and are spaced from the top of the header 10 so that water received in the header will flow down through the nozzles and onto the passing strip. The particular system illustrated operates at a relatively low water pressure so that the falling water from the nozzles 12 is given a "laminar" effect.

Referring again to FIG. 1, it will be noted that the header 10, and particularly the nozzles 12, are divided into three longitudinal sections identified as a middle section M, two inner sections I, and two outer sections O. The middle section M is fed water from a passageway 18 formed in the header, while the two inner sections I receive their water from a passageway 20 formed in the header 10. Finally, the two outer sections O receive water from the passageway 22, again formed in the header 10. In FIG. 1 it will be observed that the sections are compartmentalized into three separate cooling zones by permanent ribbing 23 so that water from the middle section M will only cover narrow strip or the central section of a wide strip, whereas, the intermediate sections I will cool in concert with the middle section a width much wider than the minimum strip; i.e. an intermediate width strip. The outer section O, of course, will be employed when the mill is rolling the maximum range of strip width, in which event all three cooling zones will be used.

The control of water to the sections M, I, and O is provided by a rotating valve 24, as shown in FIG. 3. The valve 24 comprises a cylindrical shaped gate 26 keyed at 27 to a shaft 28 which in turn is received in spaced bushings 29 mounted in the housing 30 of the valve 24. As noted in FIG. 1, the gate 26 operates with the two passageways 20 and 22 of the intermediate and outer sections I and O, respectively, of the header 10, wherein the passageways 18 of the middle section M always remains open. In this manner, the middle section will always be delivered water, whereas with respect to the intermediate and outer sections, operating the gate 26 will selectively deliver and divert water into either or both of these sections.

Figure 2:
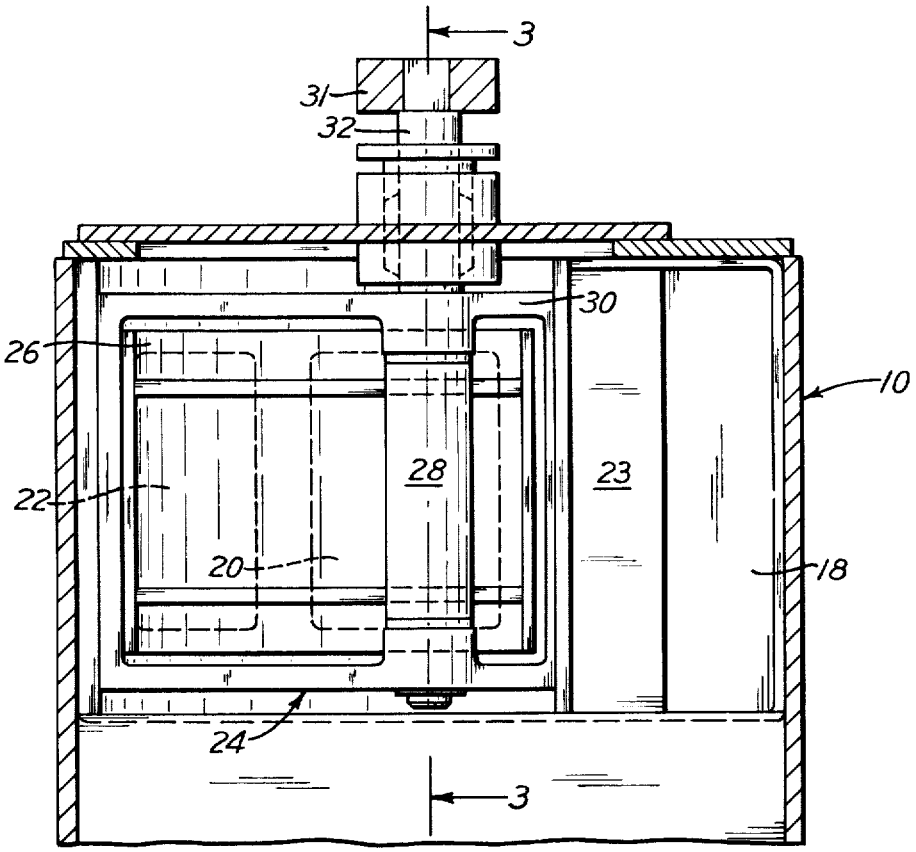
FIG. 2 is a sectional view taken on lines 2-2 of FIG. 1.

Selected operation of the valve is accomplished by rotation of an arm 31 secured to a pin 32 of the gate 26, as best shown in FIGS. 2 and 3. It will be noted in this regard that the arms for several headers, in addition to the header being shown at 34 in FIG. 1, of the bank of headers are connected to a common tie rod 36. The rod, in turn, is connected to a single piston cylinder assembly 38.

In now giving a brief description of the operation of the above described cooling apparatus and in referring to the typical mill noted earlier, let it be assumed that 84 inches width strip is to be rolled. In this event, by the proscribed operation of the piston cylinder assembly 38, the gate 26 will be moved to the full retracted phantom position in FIG. 1 so that coolant will be delivered to all three sections M, I, and O of the header 10. This valve position will be used for a strip width range of say, for example, 64 to 84 inches. Should the mill thereafter commence to roll, for example, 54 inch width strip, and let it be assumed that the middle section I is capable of cooling up to a maximum width strip of 42 inches, in this event, the gate 26 will be positioned, by the operation of the piston cylinder assembly 38, in the intermediate phantom position of FIG. 1, thereby discontinuing the flow of water to the outer section O by blocking the passageway 22 but at the same time delivering water to the passageway 20 of the intermediate section I.

Should thereafter the mill be called upon to roll a 42 inch or less width of strip, which as noted above is within the width cooling capability of middle section M, then gate 26 will be again adjusted by the operation of the piston cylinder assembly 38 to close the passageway 20 thereby stopping the flow of water to the intermediate section I, as well as O. Since water always flows to the passageway 18 associated with the middle section M, this section alone will deliver the required coolant for the 42 inch width strip. Thus, from the above it can be readily appreciated that by the employment of the present invention, the most economical use of the coolant medium is realized along with a substantial reduction in the cost of pumping power and reduced maintenance.

In accordance with the provisions of the patent statutes, I have explained the principle and operation of my invention and have illustrated and described what I consider to represent the best embodiment thereof.

I claim:

1. An apparatus for cooling varying width relatively flat strip produced by a hot strip mill, comprising:

header means mounted over a passing strip and receiving coolant medium, a number of discharge members carried by said header means arranged relative to the upper flat surface of the passing strip to form a transverse cooling zone approximately equal in width to the maximum width strip for delivering said coolant medium from said header to said upper flat surface, means for compartmentalizing said discharge members into two or more areas, including means for forming a separate passageway for each of said areas for delivering separate quantities of coolant medium to each area, and means for selectively delivering and interrupting said coolant medium for at least one of said areas of discharge members in a manner that the effective cooling width of said zone can be varied to optimize the use of the coolant medium for the particular width strip being cooled.

2. An apparatus according to claim 1, wherein said one area comprises two separate sections of discharge members arranged on both sides of said other area which other area comprises a center area and includes means for delivering in an uninterrupted fashion coolant medium to said center area.

3. An apparatus according to claim 2, in which said means for selectively delivering coolant medium comprises a valve arranged to selectively deliver coolant medium to said two sections of said discharge members.

4. An apparatus according to claim 3, wherein said header has a coolant medium intake portion, said valve arranged in said intake portion, and wherein said passageways each have a termini in said intake portion.

5. An apparatus according to claim 1, wherein said header means comprises two or more header units, a common means for operating in unison said means for selectively delivering coolant medium for each header unit.

* * * * *